US007916111B2

(12) United States Patent
Kim et al.

(10) Patent No.: US 7,916,111 B2
(45) **Date of Patent: *Mar. 29, 2011**

(54) APPARATUS FOR DRIVING LIQUID CRYSTAL DISPLAY DEVICE

(75) Inventors: Seong Gyun Kim, Gunpo-si (KR); Nam Yong Kong, Anyang-si (KR); Tae Ho You, Anyang-si (KR); Sung Woo Bae, Daegu (KR)

(73) Assignee: LG Display Co., Ltd., Seoul (KR)

( * ) Notice: Subject to any disclaimer, the term of this patent is extended or adjusted under 35 U.S.C. 154(b) by 849 days.

This patent is subject to a terminal disclaimer.

(21) Appl. No.: 11/819,128

(22) Filed: Jun. 25, 2007

(65) Prior Publication Data

US 2008/0122813 A1 May 29, 2008

(30) Foreign Application Priority Data

Jun. 26, 2006 (KR) ..... 10-2006-0057304

(51) Int. Cl.
*G09G 3/36* (2006.01)

(52) U.S. Cl. ..... 345/99

(58) Field of Classification Search ..... 345/87–102, 345/204, 690

See application file for complete search history.

(56) References Cited

U.S. PATENT DOCUMENTS

| | | | | |
|---|---|---|---|---|
| 7,321,351 | B2 * | 1/2008 | Cheon | 345/89 |
| 2005/0104837 | A1 * | 5/2005 | Baik et al. | 345/99 |
| 2005/0259739 | A1 * | 11/2005 | Nakamura et al. | 375/240.16 |
| 2007/0279531 | A1 * | 12/2007 | Muto | 348/674 |

FOREIGN PATENT DOCUMENTS

JP 2004-355017 12/2004

* cited by examiner

*Primary Examiner* — Amr Awad
*Assistant Examiner* — Stephen G Sherman
(74) *Attorney, Agent, or Firm* — McKenna Long & Aldridge LLP

(57) ABSTRACT

A device and method for driving a liquid crystal display device capable of minimizing a motion blurring phenomenon of a display image and improving the display quality of the display image are disclosed. The apparatus for driving a liquid crystal display device includes a liquid crystal panel having liquid crystal cells formed in regions defined by a plurality of gate lines and a plurality of data lines; a timing controller which analyzes a motion speed of an image in input data and converts the input data of one frame into different first and second double frame data or identical first and second double frame data according to the motion speed; a gate driver which sequentially supplies gate on voltages to the gate lines for each of first and second double frames under the control of the timing controller; and a data driver which converts the double frame data supplied from the timing controller into an analog video signal and supplies the analog video signal to the data lines under the control of the timing controller.

18 Claims, 11 Drawing Sheets

APPARATUS FOR DRIVING LIQUID CRYSTAL DISPLAY DEVICE

This application claims the benefit of Korean Patent Application No. 10-2006-0057304, filed on Jun. 26, 2006, which is hereby incorporated by reference for all purposes as if fully set forth herein.

BACKGROUND OF THE INVENTION

1. Field of the Invention

The present invention relates to a liquid crystal display device, and more particularly, to an device and method for driving a liquid crystal display device which are capable of minimizing a motion blurring phenomenon of a display image and improving the display quality of the display image.

2. Discussion of the Related Art

Recently, a cathode ray tube has been replaced with various kinds of flat-panel display device having a reduced weight and volume. The flat-panel display device includes a liquid crystal display device, a field emission display device, a plasma display panel, and a light emitting display device.

Among the flat-panel display device, the liquid crystal display device displays a moving image using a thin film transistor as a switching element. Since such a liquid crystal display device has a size smaller than that of the cathode ray tube, the liquid crystal display device is widely being used in a personal computer, a notebook computer, office automation equipments such as a copier, and a mobile device such as a mobile phone.

Meanwhile, the cathode ray tube, the plasma display panel, and the field emission display device are driven in an impulse form in which phosphor light is emitted to display data during a very short initial time of a frame period and a pause interval is held during most of the frame period, as shown in FIG. 1.

In the display device driven in the impulse form, the definition of a display image is excellent and a blurring phenomenon, in which a display image blurs, is prevented by disconnecting adjacent frame images.

In contrast, the liquid crystal display device is driven in a hold form in which data is supplied to liquid crystal by a high gate voltage during a scanning period and the data supplied to the liquid crystal is held in a non-scanning period which is substantially most of a frame period, as shown in FIG. 2. In the display device driven in the hold form, since an image is held during a frame period, a motion blurring phenomenon, in which a moving image blurs, occurs and thus display quality deteriorates.

SUMMARY OF THE INVENTION

Accordingly, the present invention is directed to a device and method for driving a liquid crystal display device that substantially obviate one or more problems due to limitations and disadvantages of the related art.

An object of the present invention is to provide a device and method for driving a liquid crystal display device, which are capable of minimizing a motion blurring phenomenon of a display image and improving the display quality of the display image.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, an apparatus for driving a liquid crystal display device includes a liquid crystal panel having liquid crystal cells formed in regions defined by a plurality of gate lines and a plurality of data lines; a timing controller which analyzes a motion speed of an image in input data and converts the input data of one frame into different first and second double frame data or identical first and second double frame data according to the motion speed; a gate driver which sequentially supplies gate on voltages to the gate lines for each of first and second double frames under the control of the timing controller; and a data driver which converts the double frame data supplied from the timing controller into an analog video signal and supplies the analog video signal to the data lines under the control of the timing controller.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
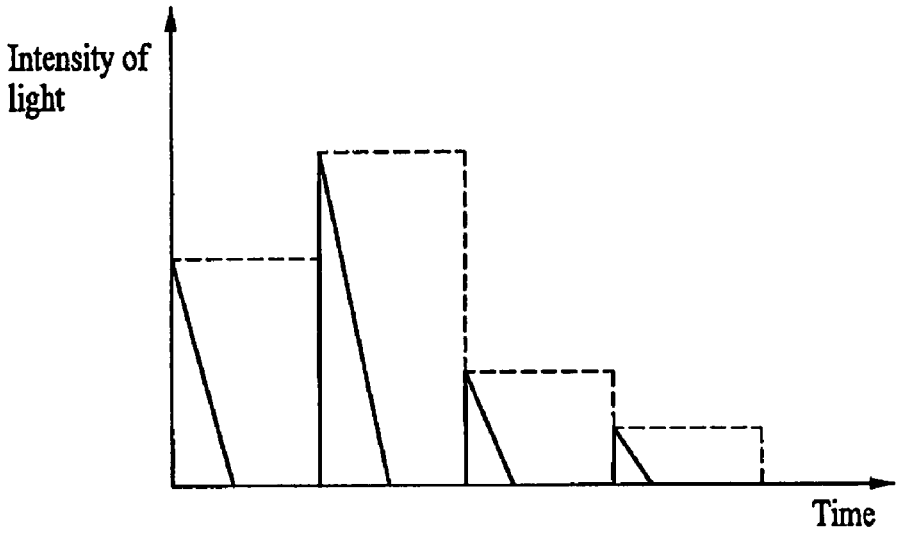
FIG. 1 Related Art
FIG. 1 is a characteristic diagram showing a driving characteristic of a display device driven in an impulse form.
Figure 2:
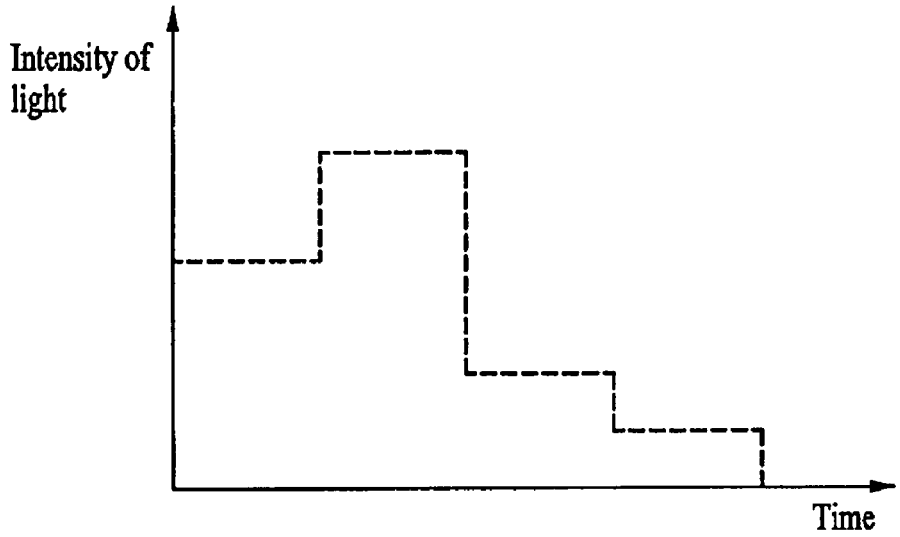
FIG. 2 Related Art
FIG. 2 is a characteristic diagram showing a driving characteristic of a display device driven in a hold form.
Figure 3:
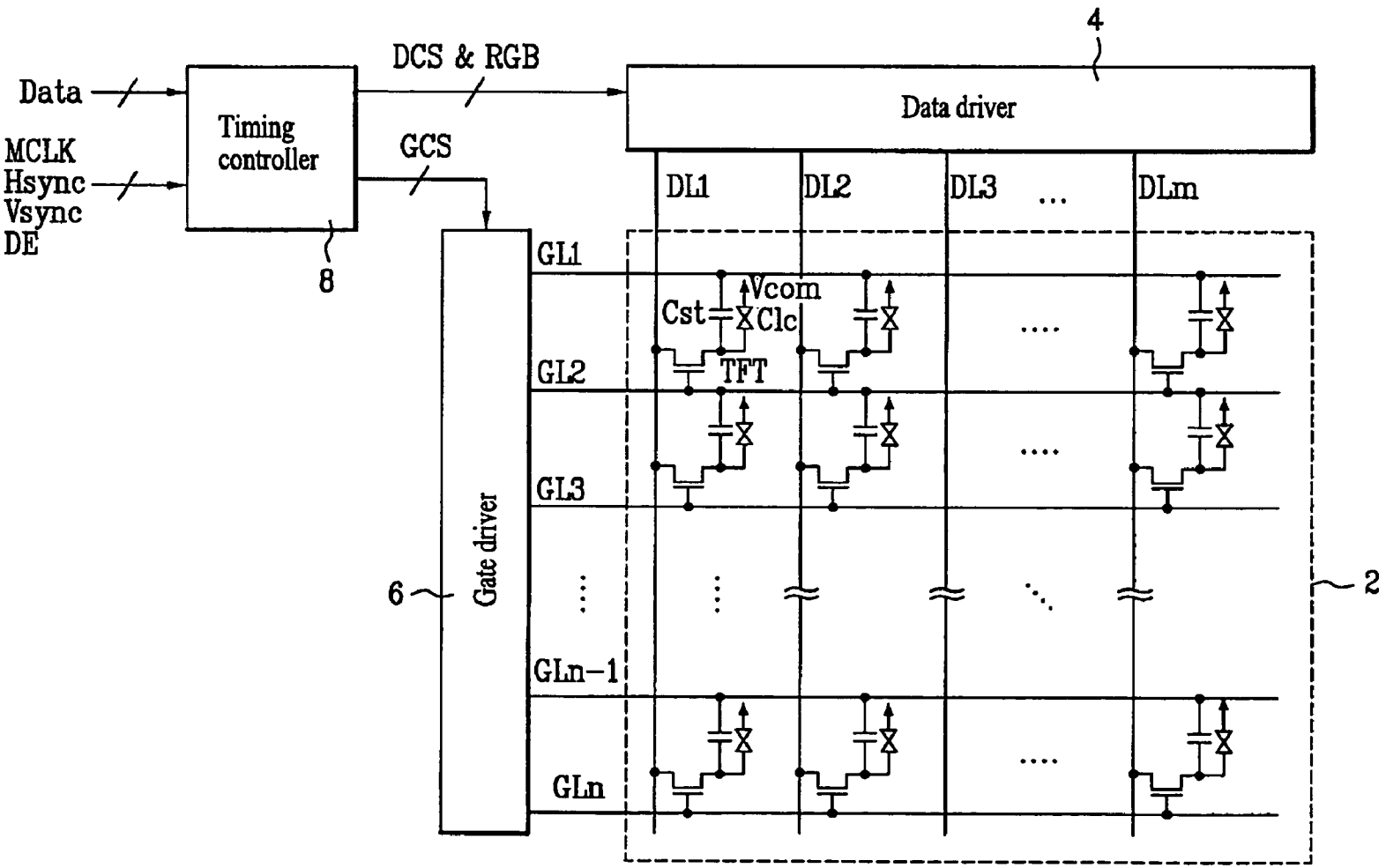
FIG. 3 is a schematic diagram showing an apparatus for driving a liquid crystal display device according to an embodiment of the present invention.

FIG. 3 is a schematic diagram showing an apparatus for driving a liquid crystal display device according to an embodiment of the present invention.

Referring to FIG. 3, the apparatus for driving the liquid crystal display device according to the embodiment of the present invention includes a liquid crystal panel 2 including liquid crystal cells formed in regions defined by n gate lines GL1 to GLn and m data lines DL1 to DLm; a timing controller 8 for converting input data Data of one frame into different first and second frame data RGB or identical first and second double frame data RGB according to the motion of the input data Data; a gate driver 6 for sequentially supplying gate on voltages to the gate lines GL1 to GLn for each of the double frames under the control of the timing controller 8; and a data driver for converting the double frame data RGB sequentially supplied from the timing controller 8 into analog video signals and supplying the analog video signals to the data lines DL1 to DLm under the control of the timing controller 8.

The liquid crystal panel 2 includes a transistor array substrate and a color filter array substrate, both of which face each other, a spacer for maintaining a constant cell gap between the two array substrates, and liquid crystal filled in a liquid crystal space provided by the spacer.

The liquid crystal panel 2 includes TFTs formed in regions defined by the n gate lines GL1 to GLn and the m data lines DL1 to DLm, and liquid crystal cells connected to the TFTs. The TFTs supply the analog video signals from the data line DL1 to DLm to the liquid crystal cells in response to the gate on voltages from the gate lines GL1 to GLn. Since each liquid cell includes a pixel electrode connected to each TFT and a common electrode, both of which face each other with the liquid crystal interposed therebetween, each liquid cell may be equivalently represented by a liquid crystal capacitor Clc. Such a liquid crystal cell includes a storage capacitor Cst for holding the analog video signal charged in the liquid crystal capacitor Clc until a next analog video signal is charged.

The timing controller 8 converts the input data Data of one frame into different first and second double frame data RGB or identical first and second double frame data RGB according to the motion of an input image, and supplies the double frame data to the data driver 4. The timing controller 8 receives the externally input data Data having a frequency of 60 Hz, generates the double frame data RGB having a frequency of 120 Hz, and supplies the double frame data to the data driver 4.

The timing controller 8 modulates a main clock MCLK, a data enable signal DE, and horizontal and vertical synchronization signals Hsync and Vsync input externally, and generates a data control signal DCS and a gate control signal GCS for respectively controlling drive timings of the data driver 4 and the gate driver 6 using at least one of the modulated main clock MCLK, the modulated data enable signal DE, and the modulated horizontal and vertical synchronization signals Hsync and Vsync, in order to display the double frame data RGB having the frequency of 120 Hz on the liquid crystal panel 2.

The gate driver 6 includes a shift register for sequentially generating the gate on voltages in response to a gate start pulse GSP and a gate shift clock GSC in the gate control signal GCS supplied from the timing controller 8. The gate driver 6 sequentially supplies the gate on voltages to the gate lines GL of the liquid crystal panel 2 and turns on the TFTs connected to the gate lines GL, for each double frame.

The data driver 4 converts the double frame data RGB supplied from the timing controller 8 to the analog video signals according to the data control signal DCS supplied from the timing controller 8, and supplies the analog video signals of one horizontal line to the data lines DL for each horizontal period when the gate on voltages are supplied to the gate lines GL for each double frame. That is, the data driver 4 selects a gamma voltage having a predetermined level according to a gray scale value of the data RGB and supplies the selected gamma voltage to the data lines DL1 to DLm. At this time, the data driver 4 inverts the polarities of the analog video signals supplied to the data lines DL in response to a polarity control signal POL supplied from the timing controller 8.

Figure 4:
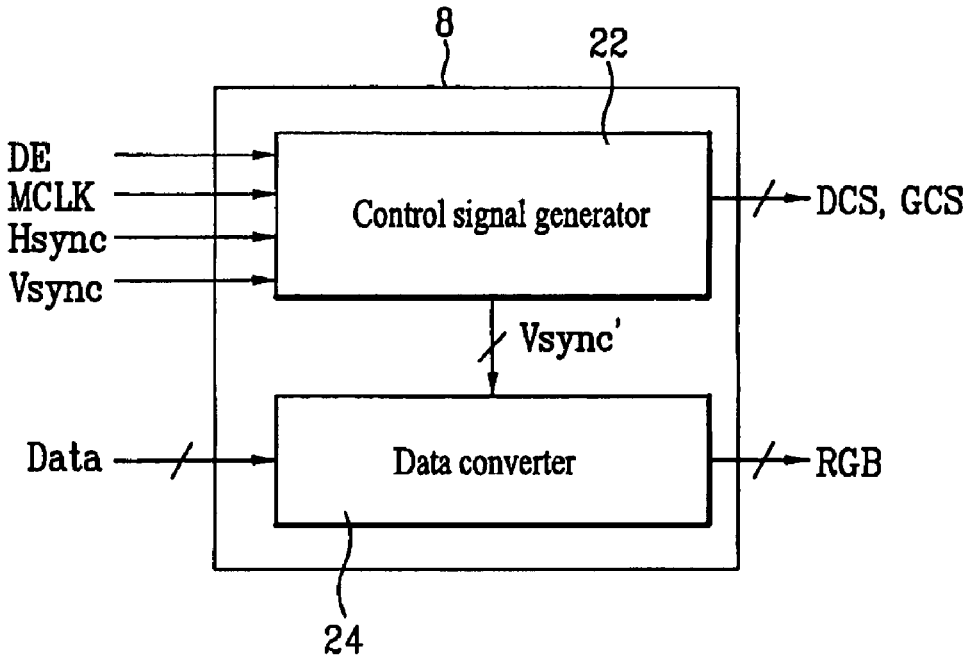
FIG. 4 is a schematic block diagram showing a timing controller according to the embodiment of the present invention.

FIG. 4 is a schematic block diagram showing the timing controller shown in FIG. 3.

Referring to FIGS. 3 and 4 together, the timing controller 8 includes a control signal generator 22 and a data converter 24.

The control signal generator 22 multiplies the frequencies of the main clock MCLK, the data enable signal DE, and the horizontal and vertical synchronization signals Hsync and Vsync input externally by 2, and generates the data control signal DCS for controlling the data driver 4 and the gate control signal GCS for controlling the gate driver 6 using at least one of the frequency-multiplied main clock MCLK, the frequency-multiplied enable signal DE, and the frequency-multiplied horizontal and vertical synchronization signals Hsync and Vsync. Here, the control signal generator 22 multiplies the frequency of the vertical synchronization signal Vsync having the frequency of 60 Hz by 2 and generates a vertical synchronization signal Vsync' having a frequency of 120 Hz.

The control signal generator 22 supplies the data control signal DCS including a source output enable SOE, a source shift clock SSC, a source start pulse SSP, and a polarity control signal POL to the data driver 4, and supplies the gate control signal GCS including a gate start pulse SSP, a gate shift clock GSC and a gate output enable signal GOE to the gate driver 6. The control signal generator 22 supplies the frequency-multiplied vertical synchronization signal Vsync' to the data converter 24.

The data converter 24 converts the input data Data of one frame into two pieces of different double frame data RGB and two pieces of identical double frame data RGB according to the motion of the input image, and supplies the double frame data RGB to the data driver 4.

Figure 5:
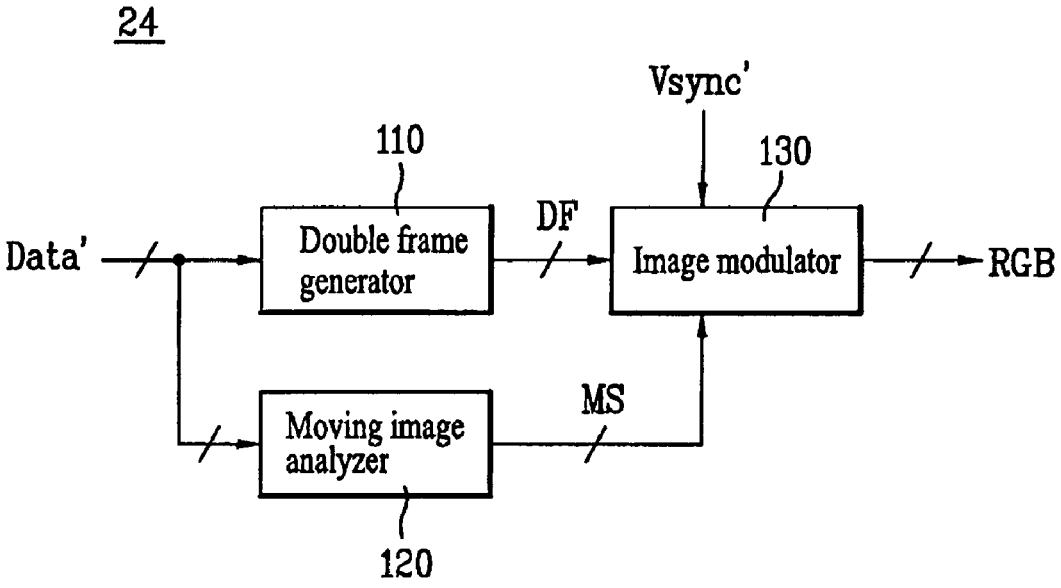
FIG. 5 is a schematic block diagram showing a data converter according to a first embodiment of the present invention.

As shown in FIG. 5, the data converter 24 according to a first embodiment of the present invention includes a double frame generator 110, a moving image analyzer 120, and an image modulator 130.

The double frame generator 110 converts the externally input data Data of one frame into two pieces of identical double frame data DF. For example, the double frame generator 110 stores the externally input data Data of one frame having a frequency of 60 Hz and supplies the stored data to the image modulator 130 so as to have a frequency of 120 Hz.

The moving image analyzer 120 analyzes whether the externally input data Data is a still image or a moving image and generates a motion signal MS.

Figure 6:
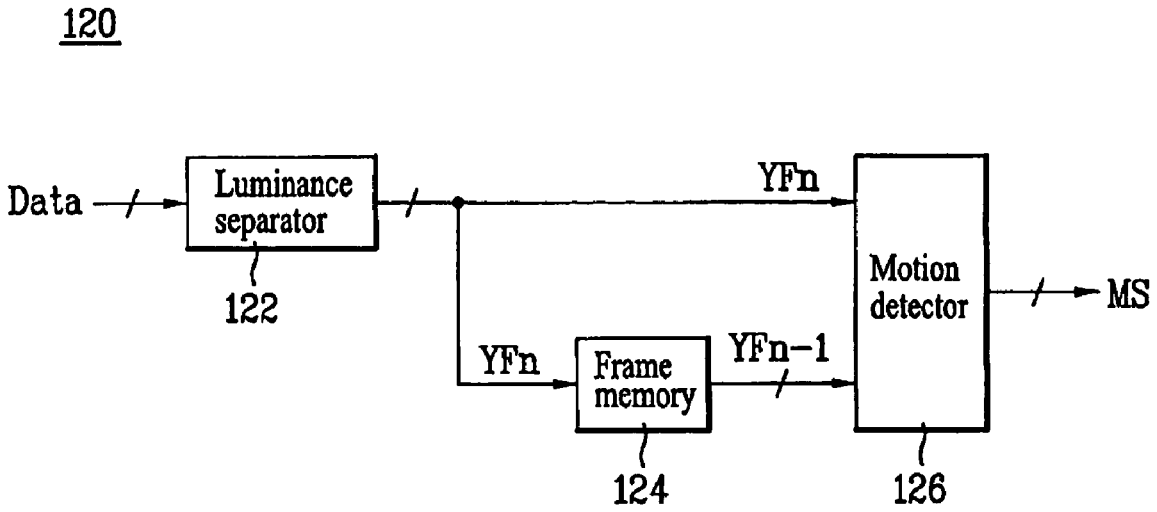
FIG. 6 is a schematic block diagram showing a moving image analyzer according to a first embodiment of the present invention.

As shown in FIG. 6, the moving image analyzer 120 includes a luminance separator 122, a frame memory 124, and a motion detector 126.

The luminance separator 122 separates luminance component Y from the externally input data Data of one frame and supplies the luminance component to the frame memory 124 and the motion detector 126.

The frame memory 124 stores the luminance component Y supplied from the luminance separator 122 in a frame unit and supplies the luminance component Y in the frame unit to the motion detector 126.

The motion detector 126 compares luminance component YFn-1 of a previous frame supplied from the frame memory 124 with luminance component YFn of a current frame and generates the motion signal MS for the motion of the image. That is, the motion detector 126 generates $0^{th}$ motion signal MS corresponding to a still image if the luminance component YFn-1 of the previous frame are identical to the luminance component YFn of the current frame.

The motion detector 126 generates a motion signal MS corresponding to a moving image if the luminance component YFn-1 of the previous frame are different from the luminance component YFn of the current frame. That is, the motion detector 126 generates a first motion signal MS when the motion distance between images of the previous frame and the current frame is 1 to 3 pixels, generates a second motion signal MS when the motion distance between images of the previous frame and the current frame is 4 to 6 pixels, or generates a third motion signal MS when the motion distance between images of the previous frame and the current frame is 7 to 10 pixels.

Figure 7:
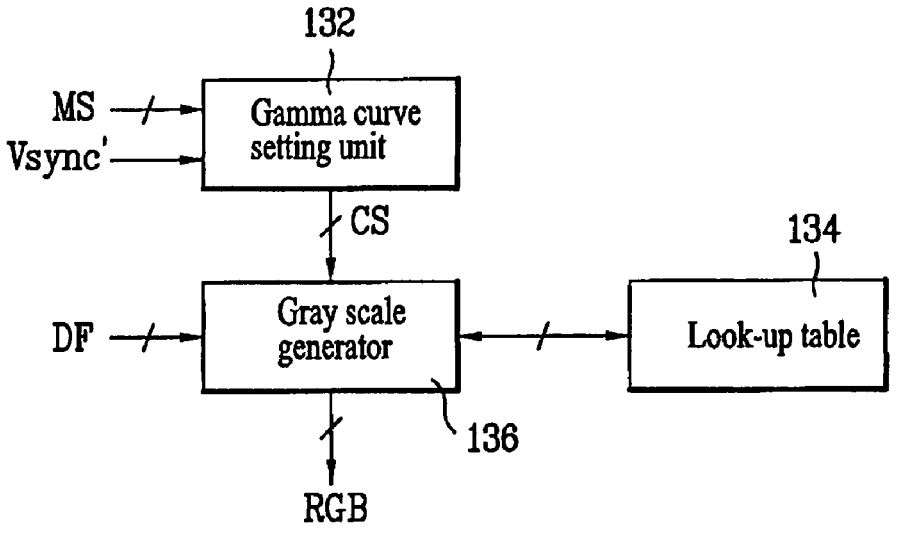
FIG. 7 is a schematic block diagram showing an image modulator according to a first embodiment of the present invention.

In FIG. 5, the image modulator 130 according to the first embodiment of the present invention includes a gamma curve setting unit 132, a look-up table 134, and a gray scale generator 136, as shown in FIG. 7.

The gamma curve setting unit 132 generates a selection signal CS corresponding to the motion signal MS supplied from the moving image analyzer 120 according to the frequency-multiplied vertical synchronization signal Vsync' supplied from the control signal generator 22, and supplies the selection signal CS to the gray scale generator 136. That is, when the $0^{th}$ motion signal MS is supplied from the moving image analyzer 120, the gamma curve setting unit 132 generates and supplies a bypass selection signal CS to the gray scale generator 136. When the frequency-multiplied vertical synchronization signal Vsync' is an $N^{th}$ frame, the gamma curve setting unit 132 generates and supplies first to third gamma curve selection signals CS for the $N^{th}$ frame corresponding to the first to third motion signals MS supplied from the moving image analyzer 120 to the gray scale generator 136. In contrast, when the frequency-multiplied vertical synchronization signal Vsync' is an $N+1^{th}$ frame, the gamma curve setting unit 132 generates and supplies first to third gamma curve selection signals CS for the $N+1^{th}$ frame corresponding to the first to third motion signals MS supplied from the moving image analyzer 120 to the gray scale generator 136.

The look-up table 134 includes a plurality of memories for registering a plurality of gamma curves for setting the gamma curve according to the motion speed of the moving image.

In more detail, the look-up table 134 includes a first memory for registering a plurality of different gamma curves for the $N^{th}$ frame for setting the gamma curve of a first double frame data DF according to the motion speed of the moving image, and a second memory for registering a plurality of different gamma curves for the $N+1^{th}$ frame for setting the gamma curve of a second double frame data DF according to the motion speed of the moving image.

Figure 8:
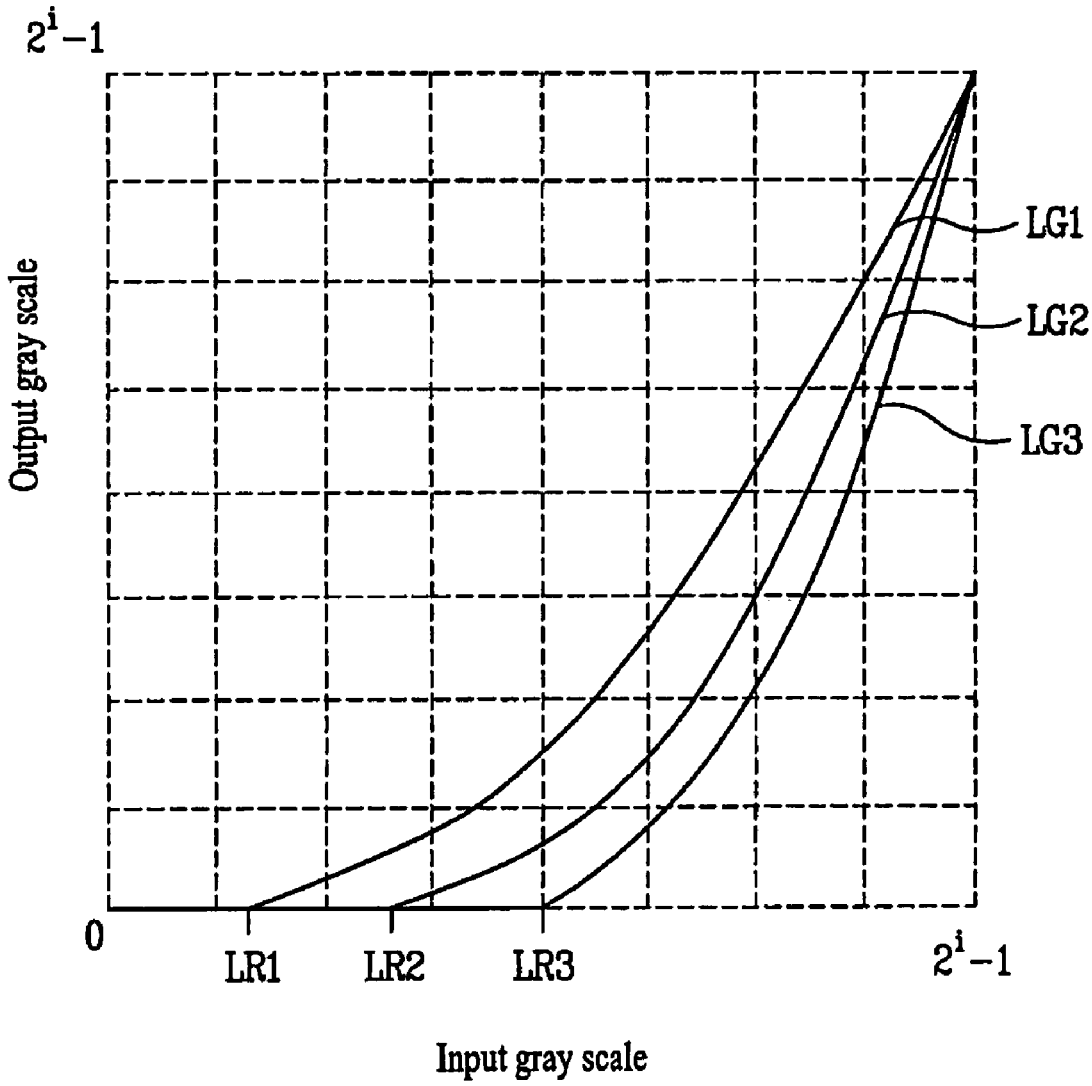
FIG. 8 is a graph showing a gamma curve for a frame $N^{th}$ according to an embodiment of the present invention.

As shown in FIG. 8, the first memory stores gray scale values corresponding to the first to third gamma curves LG1, LG2 and LG3 for the $N^{th}$ frame.

The first gamma curve LG1 for the $N^{th}$ frame has a gray scale value of '0' when the gray scale value of the input data is equal to or less than a first reference value LR1 for the $N^{th}$ frame and has gray scale values on a curved line between the first reference value LR1 for the $N^{th}$ frame and a gray scale value of '$2^i-1$' (here, i is the number of bits of the input data) when the gray scale value of the input data is greater than the first reference value LR1 for the $N^{th}$ frame. The second gamma curve LG2 for the $N^{th}$ frame has a gray scale value of '0' when the gray scale value of the input data is equal to or less than a second reference value LR2 for the $N^{th}$ frame, which is greater than the first reference value LR1 for the $N^{th}$ frame, and has gray scale values on a curved line between the second reference value LR2 for the $N^{th}$ frame and the gray scale value of '$2^i-1$' when the gray scale value of the input data is greater than the second reference value LR2 for the $N^{th}$ frame. The third gamma curve LG3 for the $N^{th}$ frame has a gray scale value of '0' when the gray scale value of the input data is equal to or less than a third reference value LR3 for the $N^{th}$ frame, which is greater than the second reference value LR2 for the $N^{th}$ frame, and has gray scale values on a curved line between the third reference value LR3 for the $N^{th}$ frame and the gray scale value of '$2^i-1$' when the gray scale value of the input data is greater than the third reference value LR3 for the $N^{th}$ frame. Here, the third reference value LR3 for the $N^{th}$ frame may be the half of the gray scale value of '$2^i-1$', and the first and second reference values LR1 and LR2 for the $N^{th}$ frame may respectively be the gray scale values located at the ⅓ and ⅔ points between the gray scale value of '0' and the third reference value LR3 for the $N^{th}$ frame. In the gray scale values on the curved lines of the first to third gamma curves LG1, LG2 and LG3 for the $N^{th}$ frame, a ratio of an output gray scale value to an input gray scale value increases as the input gray scale value increases. Meanwhile, the first to third reference values LR1, LR2 and LR3 for the $N^{th}$ frame may be reset by a user according to the motion speed.

Figure 9:
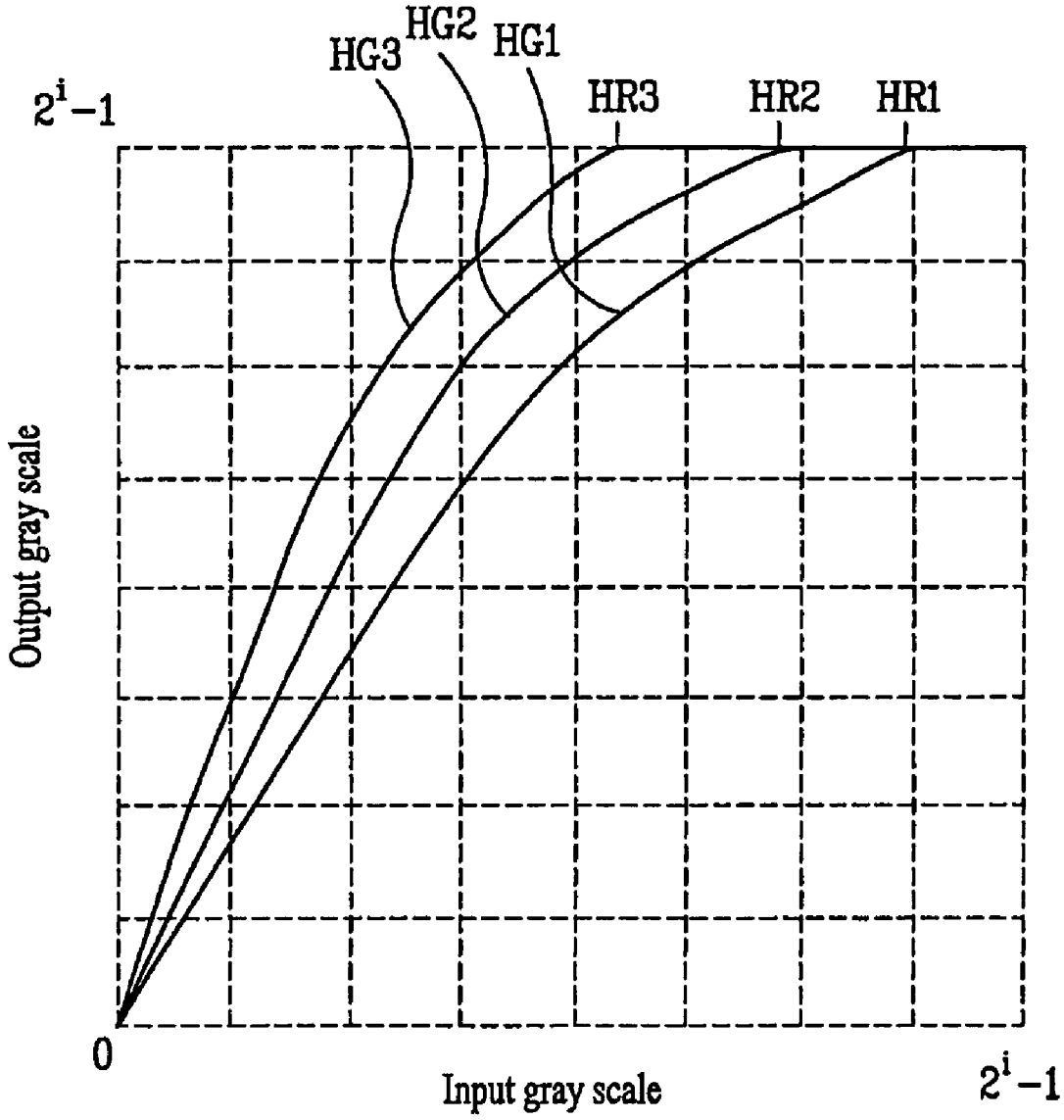
FIG. 9 is a graph showing a gamma curve for a frame $N+1^{th}$ according to an embodiment of the present invention.

As shown in FIG. 9, the second memory stores gray scale values corresponding to first to third gamma curves HG1, HG2 and HG3 for the $N+1^{th}$ frame.

The first gamma curve HG1 for the $N+1^{th}$ frame has a gray scale value of '$2^i-1$' when the gray scale value of the input data is equal to or greater than a first reference value HR1 for the $N+1^{th}$ frame and has gray scale values on a curved line between the first reference value HR1 for the $N+1^{th}$ frame and the gray scale value of '0' when the gray scale value of the input data is less than the first reference value HR1 for the $N+1^{th}$ frame. The second gamma curve HG2 for the $N+1^{th}$ frame has the gray scale value of '$2^i-1$' when the gray scale value of the input data is equal to or greater than a second reference value HR2 for the $N+1^{th}$ frame, which is less than the first reference value HR1 for the $N+1^{th}$ frame, and has gray scale values on a curved line between the second reference value HR2 for the $N+1^{th}$ frame and the gray scale value of '0' when the gray scale value of the input data is less than the second reference value HR2 for the N+1$^{th}$ frame. The third gamma curve HG3 for the N+1$^{th}$ frame has a gray scale the value of '$2^i-1$' when the gray scale value of the input data is equal to or greater than a third reference value HR3 for the N+1$^{th}$ frame, which is less than the second reference value HR2 for the N+1$^{th}$ frame, and has gray scale values on a curved line between the third reference value HR3 for the N+1$^{th}$ frame and a gray scale value of '0' when the gray scale value of the input data is less than the third reference value HR3 for the N+1$^{th}$ frame. Here, the third reference value HR3 for the N+1$^{th}$ frame may be at least the half of the gray scale value of '$2^i-1$' and the first and second reference values HR1 and HR2 for the N+1$^{th}$ frame may respectively be the gray scale values located at the ⅓ and ⅔ points between the gray scale value of '$2^i-1$' and the third reference value HR3 for the N+1$^{th}$ frame. In the gray scale values on the curved lines of the first to third gamma curves HG1, HG2 and HG3 for the N+1$^{th}$ frame, a ratio of an output gray scale value to an input gray scale value decreases as the input gray scale value increases. Meanwhile, the first to third reference values HR1, HR2 and HR3 for the N+1$^{th}$ frame may be reset by a user according to the motion speed.

The gray scale generator 136 bypasses the double frame data DF supplied from the double frame generator 110 to the data driver 4 or modulates the double frame data DF to supply the modulated double frame data to the data driver 4, according to the selection signal CS supplied from the gamma curve setting unit 132.

In more detail, the gray scale generator 136 bypasses the first and second double frame data DF successively supplied from the double frame generator 110 to the data driver 4, and outputs the original input data of one frame without modulation, when receiving the bypass selection signal CS.

In contrast, the gray scale generator 136 modulates the input double frame data DF according to the first to third gamma curves LG1 to LG3 or HG1 to HG3 stored in the look-up table 134, and supplies the modulated double frame data to the data driver 4, when receiving the first to third gamma curve selection signals CS for the N$^{th}$ frame or the N+1$^{th}$ frame.

In more detail, the gray scale generator 136 modulates the double frame data DF according to the first gamma curve LG1 for the N$^{th}$ frame when receiving the first gamma curve selection signal CS for the N$^{th}$ frame, modulates the double frame data DF according to the second gamma curve LG2 for the N$^{th}$ frame when receiving the second gamma curve selection signal CS for the N$^{th}$ frame, and modulates the double frame data DF according to the third gamma curve LG3 for the N$^{th}$ frame when receiving the third gamma curve selection signal CS for the N$^{th}$ frame.

The gray scale generator 136 modulates the double frame data DF according to the first gamma curve HG1 for the N+1$^{th}$ frame when receiving the first gamma curve selection signal CS for the N+1$^{th}$ frame, modulates the double frame data DF according to the second gamma curve HG2 when receiving the second gamma curve selection signal CS for the N+1$^{th}$ frame, and modulates the double frame data DF according to the third gamma curve HG3 for the N+1$^{th}$ frame when receiving the third gamma curve selection signal CS for the N+1$^{th}$ frame.

The image modulator 130 according to the first embodiment of the present invention bypasses the first and second double frame data DF supplied from the double frame generator 110 to the data driver 4 without modulation such that the original data of one frame is displayed without alteration, when receiving the motion signal MS corresponding to the still image.

The image modulator 130 according to the first embodiment of the present invention differently sets the gamma curves on a frame-by-frame basis according to the motion signal MS corresponding to the motion speed of the moving image, modulates the first and second double frame data DF supplied from the double frame generator 110, and supplies the modulated first and second double frame data DF to the data driver 4, when receiving the motion signal MS corresponding to the moving image. The image modulator 130 according to the first embodiment of the present invention modulates the first double frame data DF to a low gray scale so as to become close to the gray scale value of '0' as the motion speed increases in the N$^{th}$ frame. The image modulator 130 according to the first embodiment of the present invention modulates the second double frame data DF to a high gray scale so as to become close to the gray scale value of '$2^i-1$' as the motion speed increases in the N+1$^{th}$ frame.

Figure 10:
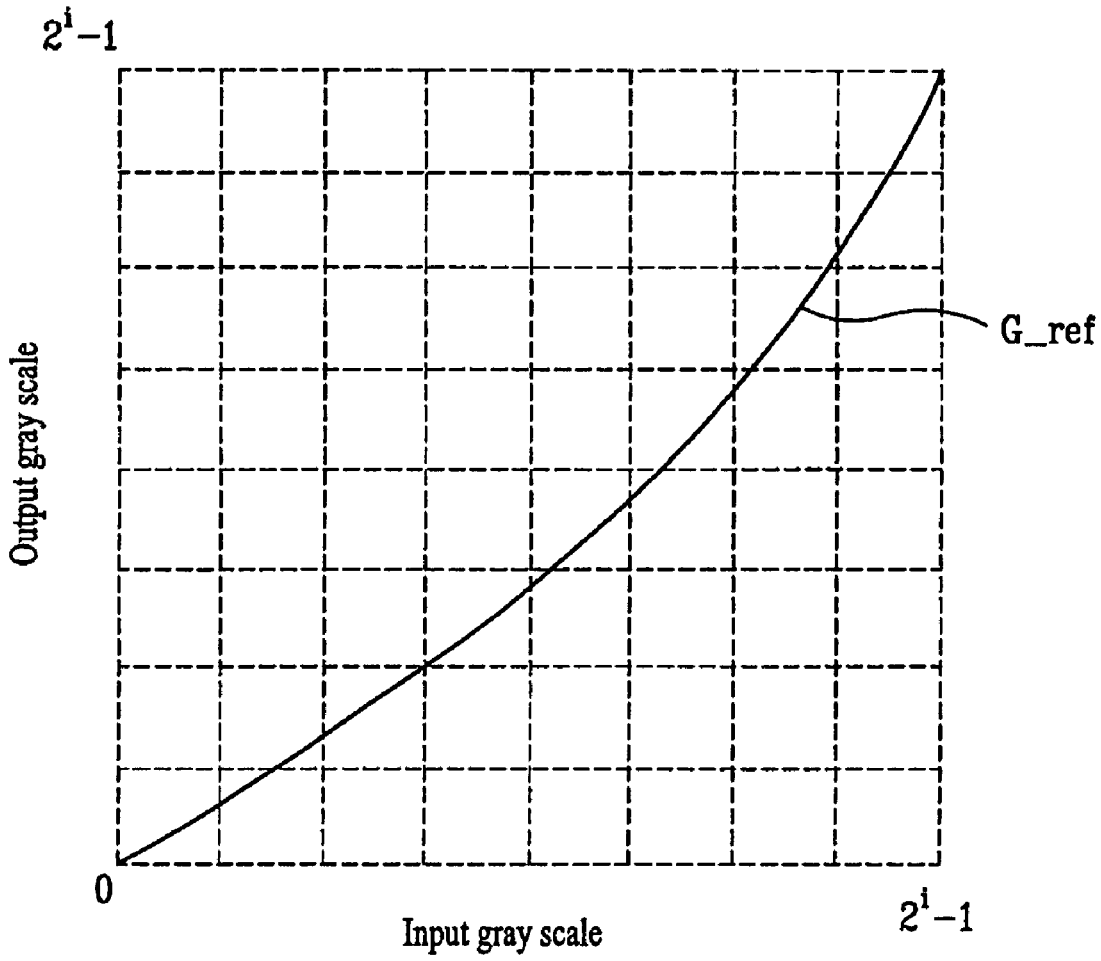
FIG. 10 is a graph showing a gamma curve of input data according to an embodiment of the present invention.

Meanwhile, as shown in FIG. 10, the gamma curve of the first and second double frame data DF output from the image modulator 130 according to the first embodiment of the present invention is identical to the gamma curve of the original input data Data of one frame.

The apparatus for driving the liquid crystal display device according to the embodiment of the present invention displays the first and second double frame data DF identical to the original image on the liquid crystal panel 2 if the input data is a still image, and modulates the original image to the first and second double frame data DF, sets the gamma curves LG1 to LG3 and HG1 to HG3 according to the motion speed of the moving image, relatively darkly displays the first double frame data DF on the liquid crystal panel 2, and relatively brightly displays the second double frame data DF on the liquid crystal panel 2, if the input data is a moving image.

Accordingly, the apparatus for driving the liquid crystal display device according to the embodiment of the present invention can display a still image without noise, that is, flicker, and can display a high-definition moving image without motion blurring.

Figure 11:
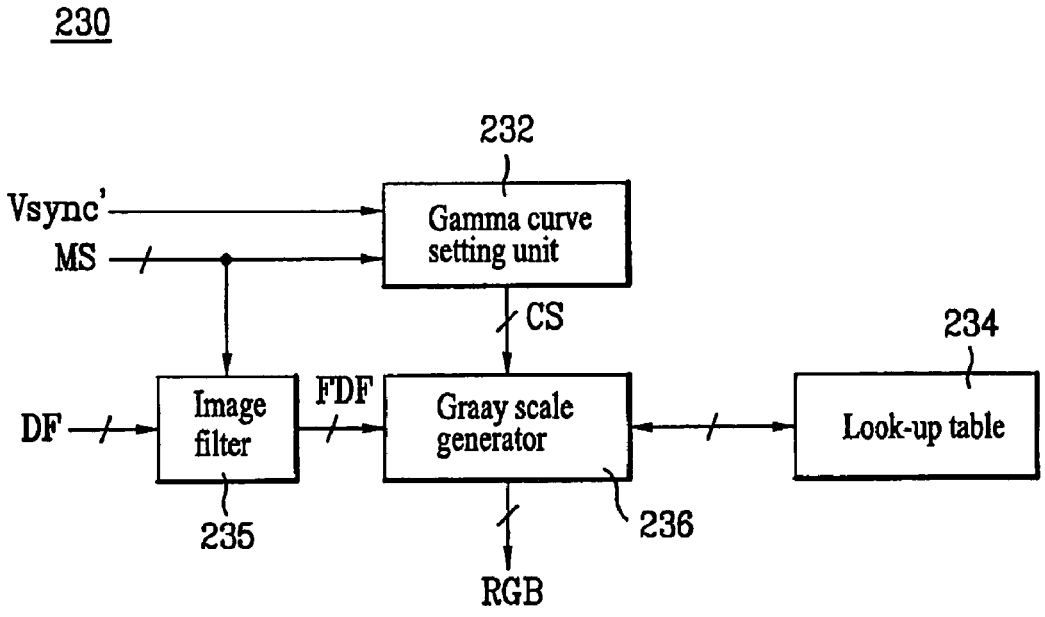
FIG. 11 is a schematic block diagram showing an image modulator according to a second embodiment of the present invention.

FIG. 11 is a schematic block diagram showing an image modulator 230 according to a second embodiment of the present invention.

Referring to FIG. 11, the image modulator 230 according to the second embodiment of the present invention includes a gamma curve setting unit 232, a look-up table 234, an image filter 235, and a gray scale generator 236.

The gamma curve setting unit 232 and the look-up table 234 respectively are equal to the gamma curve setting unit 132 and the look-up table 134 of the image modulator 130 according to the first embodiment of the present invention shown in FIG. 7 and thus the detailed description thereof will be omitted.

Figure 12:
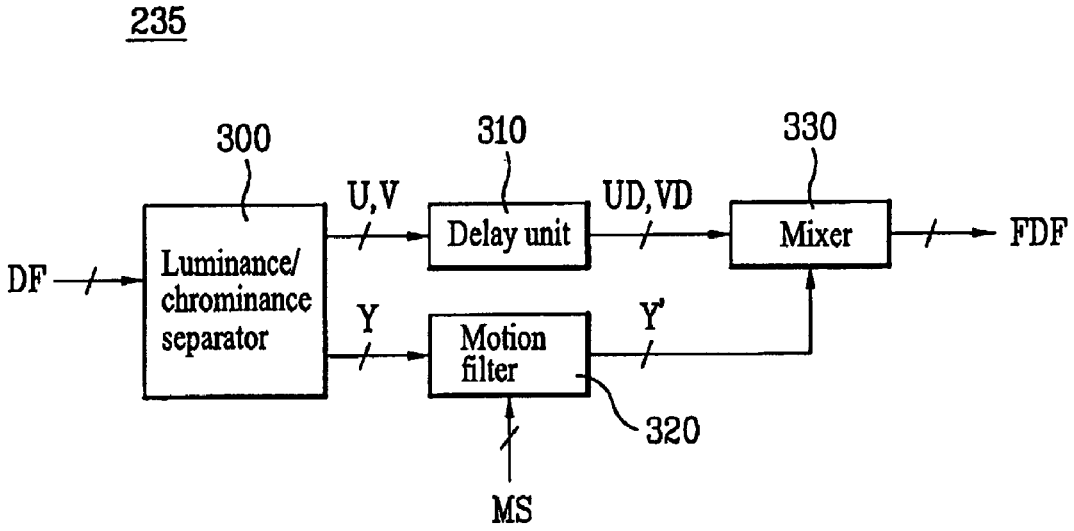
FIG. 12 is a schematic block diagram showing an image filter according to an embodiment of the present invention.

As shown in FIG. 12, the image filter 235 includes a luminance/chrominance separator 300, a delay unit 310, a motion filter 320, and a mixer 330.

The luminance/chrominance separator 300 separates luminance component Y and chrominance components U and V from the double frame data DF supplied from the double frame generator.

The delay unit 310 delays the chrominance components U and V in a frame unit while the motion filter 320 modulates the luminance component Y in the frame unit, and supplies the delayed chrominance components UD and VD to the mixer 330.

The motion filter 320 filters the luminance component Y supplied from the luminance/chrominance separator 300 according to the motion signal MS supplied from the moving image analyzer 120 and supplies the filtered luminance component Y' to the mixer 330.

Figure 13:
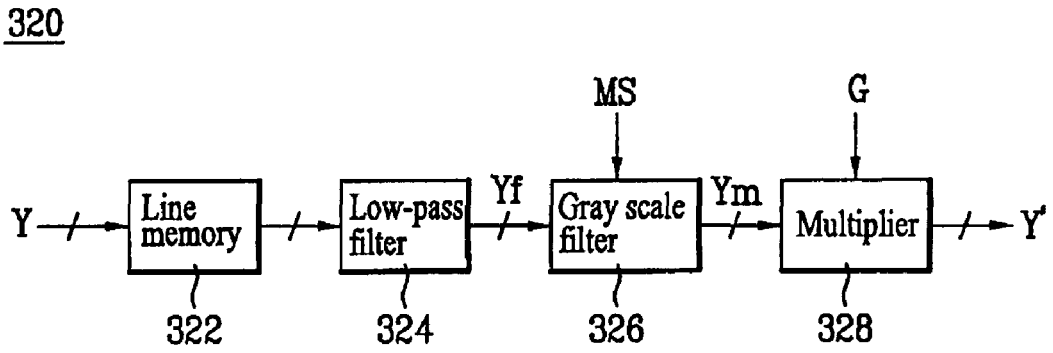
FIG. 13 is a schematic block diagram showing a motion filter according to an embodiment of the present invention.

As shown in FIG. 13, the motion filter 320 includes a line memory 322, a low-pass filter 324, a gray scale filter 326, and a multiplier 328.

The line memory 322 stores the luminance component Y of at least three horizontal lines using at least three line memories for storing the luminance component Y supplied from the luminance/chrominance separator 300 in a horizontal line unit, and supplies the luminance component Y in an j×j block unit (here, j is an integer of 3 or more) to the low-pass filter 324.

The low-pass filter 324 receives the luminance component Y in the j×j block unit from the line memory 322, low-pass filters the luminance component Y, and supplies the filtered luminance component Yf to the gray scale filter 326. The low-pass filter 324 expands a Gaussian distribution of the luminance component Y based on j×j block unit using the luminance component Y in the j×j block unit. The luminance component Yf low-pass filtered by the low-pass filter 324 become a smooth image.

Figure 14:
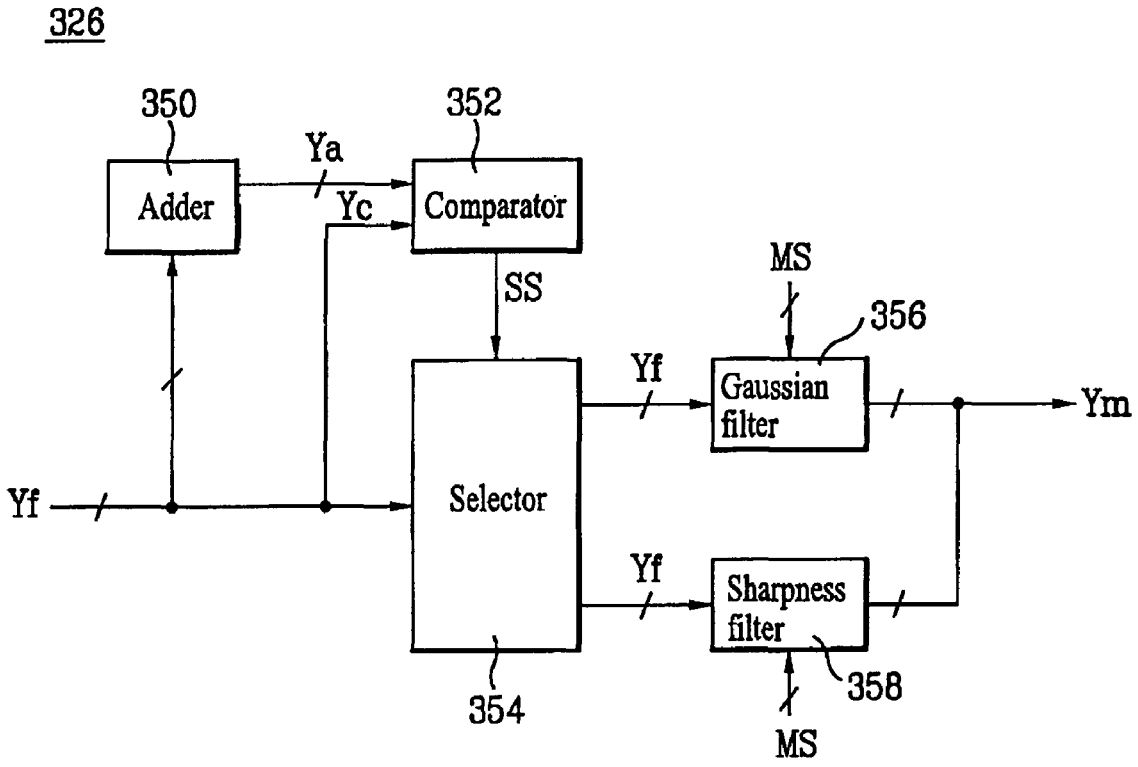
FIG. 14 is a schematic block diagram showing a gray scale filter according to an embodiment of the present invention.

As shown in FIG. 14, the gray scale filter 326 includes an adder 350, a comparator 352, a selector 354, a Gaussian filter 356, and a sharpness filter 358.

The adder 350 adds a luminance component Yf of a peripheral portion except for a central portion in the luminance component Yf based on j×j block units, which are processed by low pass filtering by the low-pass filter 324, and supplies the added luminance component Ya to the comparator 352.

The comparator 352 compares the luminance component Ya added by the adder 350 with the luminance component Yc of the central portion in the luminance component Yf based on j×j block unit low-pass filtered by the low-pass filter 324, and generates a comparison signal SS having first and second logic states. At this time, the comparator 352 generates a comparison signal SS having the first logic state when the luminance component Yc of the central portion is larger than the added luminance component Ya and generates the comparison signal SS having the second logic state when the luminance component Yc of the central portion is equal to or smaller than the added luminance component Ya.

The selector 354 supplies the luminance component Yf low-pass filtered by the low-pass filter 324 to the Gaussian filter 356 according to the comparison signal SS having the first logic state supplied from the comparator 352. The selector 354 supplies the luminance component Yf low-pass filtered by the low-pass filter 324 to the sharpness filter 358 according to the comparison signal SS having the second logic state supplied from the comparator 352.

The Gaussian filter 356 filters the low-pass filtered luminance component Yf supplied from the selector 354 according to the motion signal MS supplied from the moving image analyzer 120 such that summation of the low-pass filtered luminance component Yf becomes '1' and supplies the filtered luminance component to the multiplier 328. The Gaussian filter 356 smoothly filters the luminance component Yf based on j×j block unit so as to minimize an overshoot generated in the luminance component Yf based on j×j block unit.

The sharpness filter 358 filters the low-pass filtered luminance component Yf supplied from the selector 354 according to the motion signal MS supplied from the moving image analyzer 120 such that summation of the low-pass filtered luminance component Yf becomes '0' and supplies the filtered luminance component to the multiplier 328. At this time, in the luminance component Ym based on j×j block unit filtered by the sharpness filter 358, since the luminance component of the central portion has a value larger than that of the luminance component of the peripheral portion but the luminance component of the peripheral portion has a value smaller than that of the luminance component of the central portion, the sum thereof becomes '0'. The sharpness filter 358 sharply filters the luminance component based on j×j block unit such that undershoot is generated in the luminance component Yf based on j×j block unit according to the motion speed of the moving image corresponding to the motion signal MS.

The gray scale filter 326 filters the luminance component Yf based on j×j block unit low-pass filtered by the low-pass filter 324 such that the overshoot is minimized and the undershoot is generated in the boundary of the moving image according to the motion signal MS.

The multiplier 328 multiplies the luminance component Ym supplied from the gray scale filter 326 by an externally input gain value G, and supplies the filtered luminance component Y' to the mixer 330. The level of the undershoot generated in the boundary of the moving image in the filtered luminance component Y' is adjusted by the gain value.

In FIG. 12, the mixer 330 mixes the luminance component Y' filtered by the motion filter 320 with the chrominance components UD and VD delayed by the delay unit 310, and generates a filtered double frame data FDF.

The image filter 235 filters the double frame data DF such that a black line is clearly drawn on the boundary of the moving image by only the undershoot except for the overshoot which is sensitive to the visibility of a person, and supplies the filtered double frame data FDF to the gray scale generator 236.

In FIG. 11, the gray scale generator 236 bypasses the filtered double frame data FDF supplied from the mixer 330 of the image filter 235 or modulates the filtered double frame data FDF to supply the modulated signal to the data driver 4, according to the selection signal CS supplied from the gamma curve setting unit 232 to the data driver 4.

The gray scale generator 236 is equal to the gray scale section 136 of the image modulator 130 of the first embodiment of the present invention and thus the detailed description will be omitted.

The apparatus for driving the liquid crystal display device including the second modulator 230 according to the second embodiment of the present invention displays the first and second double frame data DF equal to the original image on the liquid crystal panel 2 if the input data of one frame is a still image, and modulates the original image to the first and second double frame data DF, Gaussian- or sharpness-filters the boundary of the moving image in the first and second double frame data DF according to the motion speed of the moving image, sets the gamma curve according to the motion speed, relatively darkly displays the first double frame data DF on the liquid crystal panel 2, and relatively brightly displays the second double frame data DF on the liquid crystal panel 2, if the input data of one frame is a moving image.

Accordingly, the apparatus for driving the liquid crystal display device including the image modulator 230 according to the second embodiment of the present invention can display a still image without noise, that is, flicker, and can display a high-definition stereoscopic moving image without motion blurring by filtering an image such that only an undershoot is generated in the boundary of the moving image according to the motion speed of the moving image.

Figure 15:
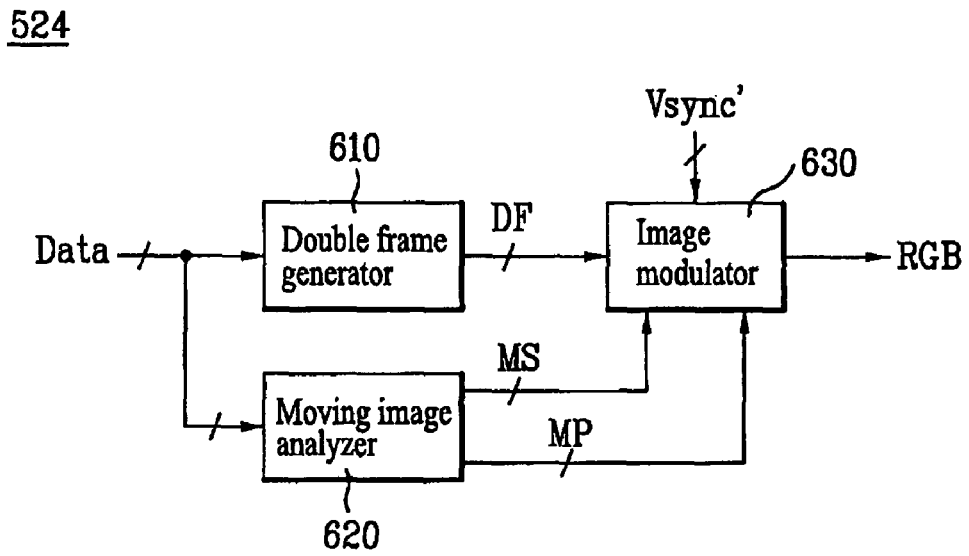
FIG. 15 is a schematic block diagram showing a data converter according to a second embodiment of the present invention.

FIG. 15 is a schematic block diagram showing a data converter according to a second embodiment of the present invention.

Referring to FIGS. 15 and 4 together, the data converter 524 according to the second embodiment of the present invention includes a double frame generator 610, a moving image analyzer 620, and an image modulator 630.

The double frame generator 610 is equal to the double frame generator 110 shown in FIG. 5 and thus the detailed description thereof will be omitted.

Figure 16:
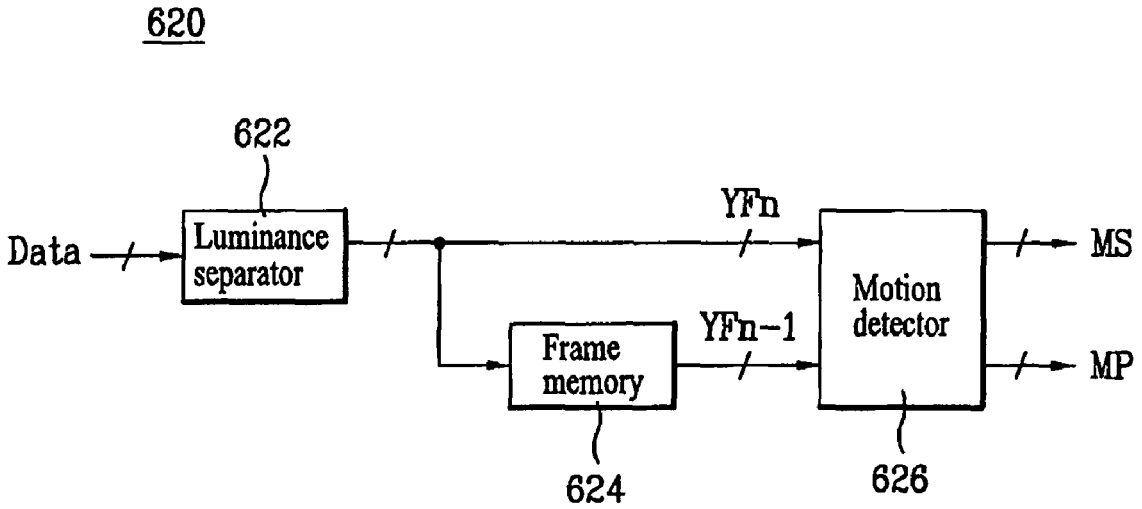
FIG. 16 is a schematic block diagram showing a moving image analyzer according to a second embodiment of the present invention.

As shown in FIG. 16, the moving image analyzer 620 includes a luminance separator 622, a frame memory 624, and a motion detector 626.

The luminance separator 622 separates luminance component Y from the externally input data Data of one frame and supplies the luminance component Y to the frame memory 624 and the motion detector 626.

The frame memory 624 stores the luminance component Y supplied from the luminance separator 622 in a frame unit, and supplies the stored luminance component Y in the frame unit to the motion detector 626.

The motion detector 626 compares luminance component YFn-1 of a previous frame supplied from the frame memory 624 with the luminance component YFn of a current frame in the same manner as the description of FIG. 6 and generates the motion signal MS for the motion of an image. The motion generator 626 for generating the motion signal MS is equal to the motion detector 126 shown in FIG. 6 and thus the detailed description thereof will be omitted.

The motion detector 626 generates motion position information MP of the boundary of the moving image, and supplies the motion position information MP to the image modulator 630, if the input data is the moving image. Here, the motion position information MP is address information of vertical and horizontal pixels for the boundary of the moving image on the liquid crystal panel 2.

Figure 17:
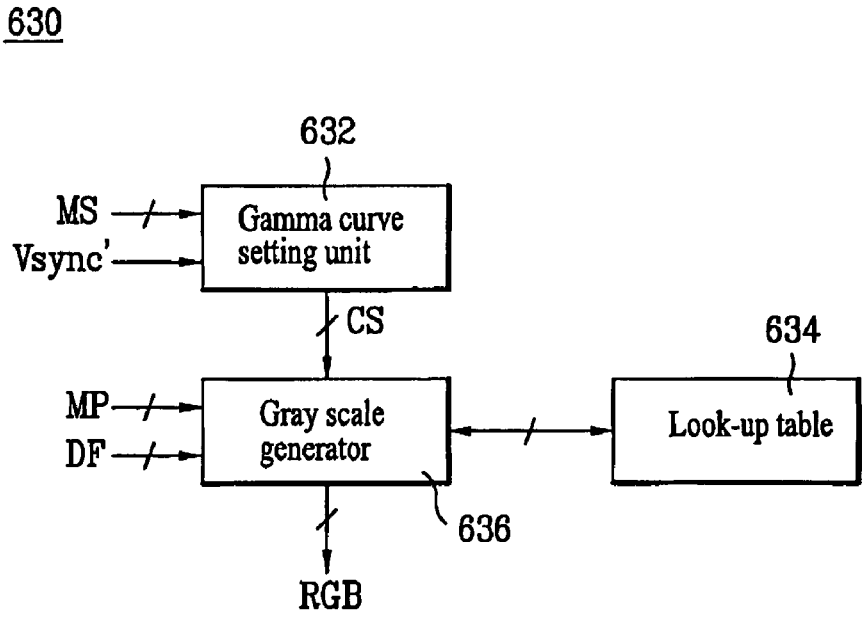
FIG. 17 is a schematic block diagram showing an image modulator according to a third embodiment of the present invention.

FIG. 17 is a schematic block diagram showing an image modulator according to a third embodiment of the present invention.

Referring to FIGS. 17 and 15, the image modulator 630 according to the third embodiment of the present invention includes a gamma curve setting unit 632, a look-up table 634, and a gray scale generator 636.

The gamma curve setting unit 632 and the look-up table 634 respectively are equal to the gamma curve setting unit 132 and the look-up table 134 of the image modulator 130 according to the first embodiment of the present invention shown in FIG. 7 and thus the detailed description thereof will be omitted.

The gray scale generator 636 bypasses the double frame data DF supplied from the double frame generator 610 to the data driver 4 or modulates the double frame data DF to supply the modulated double frame data to the data driver 4, according to the selection signal CS supplied from the gamma curve setting unit 632.

In more detail, the gray scale generator 636 bypasses the first and second double frame data DF successively supplied from the double frame generator 610 to the data driver 4 and outputs the original input data of one frame without modulation, when receiving the bypass selection signal CS.

In contrast, the gray scale generator 636 modulates the data of the boundary of the moving image corresponding to the motion position information MP supplied from the moving image analyzer 620 in the input double frame data DF according to the first to third gamma curves LG1 to LG3 for the $N^{th}$ frame or the first to third gamma curves HG1 to HG3 for the $N+1^{th}$ frame stored in the look-up table 634, and supplies the modulated double frame data to the data driver 4, when receiving the first to third gamma curve selection signals CS for the $N^{th}$ frame or the $N+1^{th}$ frame. That is, the gray scale generator 636 modulates only the data of the boundary of the moving image by referring to the different gamma curves LG1 to LG3 and HG1 to HG3 according to the motion speed such that the gray scale of the boundary of the moving image is reduced to prevent a discontinuous artifact from being generated.

The first to third gamma curves LG1 to LG3 for the $N^{th}$ frame and the first to third gamma curves HG1 to HG3 for the $N+1^{th}$ frame, which are set in the frame unit according to the motion signal MS, are the same as described above and thus the detailed description thereof will be omitted.

The apparatus for driving the liquid crystal display device including the data converter 524 having the image modulator 630 according to the second embodiment of the present invention displays the first and second double frame data DF identical to the original image on the liquid crystal panel 2 if the input data is a still image, and modulates the original image to the first and second double frame data DF, sets the gamma curves LG1 to LG3 and HG1 to HG3 according to the motion speed of the moving image, relatively darkly displays only the data of the boundary of the moving image in the first double frame data DF on the liquid crystal panel 2, and relatively brightly displays only the data of the boundary of the moving image in the second double frame data DF on the liquid crystal panel 2, if the input data is a moving image.

Accordingly, the apparatus for driving the liquid crystal display device including the data converter 524 according to the third embodiment of the present invention can display a still image without noise, that is, flicker, and can display a high-definition moving image without motion blurring by preventing a discontinuous artifact from being generated in the boundary of the moving image according to the motion speed of the moving image.

Figure 18:
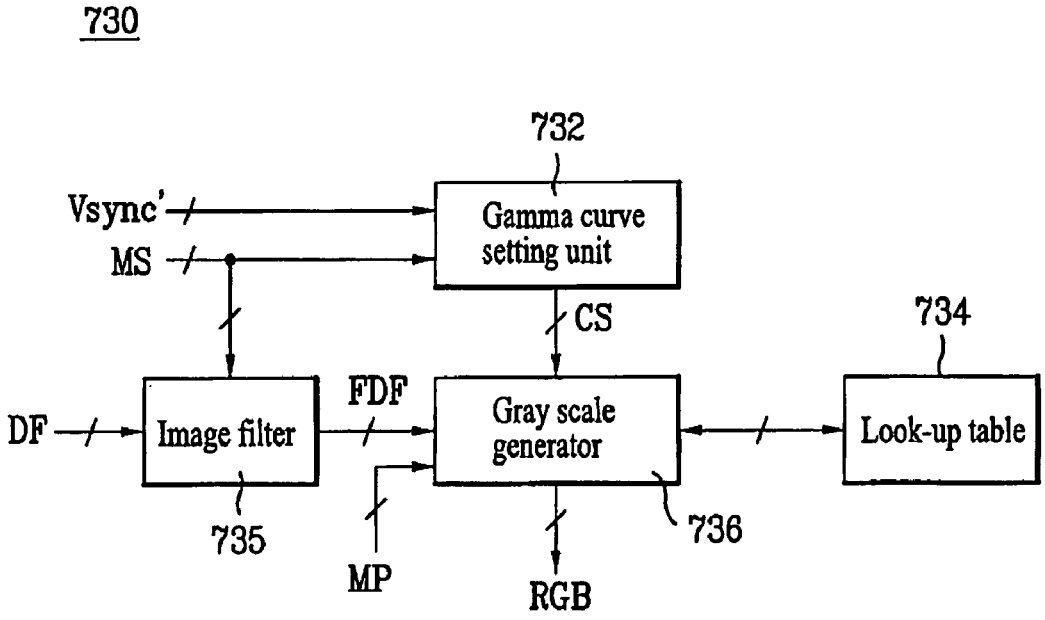
FIG. 18 is a schematic block diagram showing an image modulator according to a fourth embodiment of the present invention.

FIG. 18 is a schematic block diagram showing an image modulator according to a fourth embodiment of the present invention.

Referring to FIGS. 18 and 15 together, the image modulator 730 according to the fourth embodiment of the present invention includes a gamma curve setting unit 732, a look-up table 734, an image filter 735, and a gray scale generator 736.

The gamma curve setting unit 732 and the look-up table 734 respectively are equal to the gamma curve setting unit 132 and the look-up table 134 of the image modulator 130 according to the first embodiment of the present invention shown in FIG. 7 and thus the detailed description thereof will be omitted.

The image filter 735 filters the double frame data DF by the same manner as the image filter 235 shown in FIGS. 12 and 14 and supplies the filtered data to the gray scale generator 736. That is, if the received data is a moving image, the image filter 735 filters the double frame data DF such that that a black line is clearly drawn on the boundary of the moving image by only the undershoot except for the overshoot which is sensitive to the visibility of a person.

The gray scale generator 736 bypasses the double frame data DF supplied from the image filter 735 to the data driver 4 or modulates the double frame data DF to supply the modulated double frame data to the data driver 4, according to the selection signal CS supplied from the gamma curve setting unit 732.

In more detail, the gray scale generator 736 bypasses the first and second double frame data DF successively supplied from the image filter 735 to the data driver 4 and outputs the original input data of one frame without modulation, when receiving the bypass selection signal CS.

In contrast, the gray scale generator 736 modulates the data of the boundary of the moving image corresponding to the motion position information MP supplied from the moving image analyzer 620 in the input double frame data DF according to the first to third gamma curves LG1 to LG3 for the $N^{th}$ frame or the first to third gamma curves HG1 to HG3 for the $N+1^{th}$ frame stored in the look-up table 734, and supplies the modulated double frame data to the data driver 4, when receiving the first to third gamma curve selection signals CS for the $N^{th}$ frame or the $N+1^{th}$ frame. That is, the gray scale generator 736 modulates only the data of the boundary of the moving image by referring to the different gamma curves LG1 to LG3 and HG1 to HG3 according to the motion speed such that the gray scale of the boundary of the moving image is reduced to prevent a discontinuous artifact from being generated.

The first to third gamma curves LG1 to LG3 for the $N^{th}$ frame and the first to third gamma curves HG1 to HG3 for the $N+1^{th}$ frame, which are set in the frame unit according to the motion signal MS, are the same as described above and thus the detailed description thereof will be omitted.

The apparatus for driving the liquid crystal display device including the data converter 524 having the image modulator 730 according to the fourth embodiment of the present invention displays the first and second double frame data DF identical to the original image on the liquid crystal panel 2 if the input data is a still image, and modulates the original image to the first and second double frame data DF, and Gaussian-filters or Sharpness-filters the boundary of the moving image in the first and second double frame data DF according to the motion speed of the moving image, sets the gamma curves LG1 to LG3 and HG1 to HG3 according to the motion speed of the moving image, relatively darkly displays only the data of the boundary of the moving image in the first double frame data DF on the liquid crystal panel 2, and relatively brightly displays only the data of the boundary of the moving image in the second double frame data DF on the liquid crystal panel 2, if the input data is a moving image.

Accordingly, the apparatus for driving the liquid crystal display device including the data converter 524 including the image modulator 730 according to the fourth embodiment of the present invention can display a still image without noise, that is, flicker, and can display a high-definition stereoscopic moving image without motion blurring by preventing a discontinuous artifact from being generated in the boundary of the moving image according to the motion speed of the moving image.

As described above, according to an device and method for driving a liquid crystal display device of the embodiments of the present invention, if an input data is a still image of one frame, it is possible to display the still image without noise, that is, flicker, by displaying first and second double frame data equal to an original image on a liquid crystal panel.

If the input data is a moving image of one frame, since the original data is modulated to first and second double frame data, gamma curves are set according to the motion speed of the moving image, the first double frame data is relatively darkly modulated and displayed on the liquid crystal panel, and the second double frame data is relatively brightly modulated and displayed on the liquid crystal panel, it is possible to display a high-definition moving image without motion blurring.

If the input data is a moving image of one frame, since the boundary of the moving image in the first and second double frame data is Gaussian- or Sharpness-filtered according to the motion speed of the moving image and the image is filtered such that only an undershoot is generated in the boundary of the moving image according to the motion speed of the moving image, it is possible to display a high-definition stereoscopic moving image without motion blurring.

If the input data is a moving image of one frame, since gamma curves are set according to the moving speed of the moving image, only the data of the boundary of the moving image in the first double frame data is relatively darkly modulated, and only the data of the boundary of the moving image in the second double frame data is relatively brightly modulated such that a discontinuous artifact is prevented from being generated in the boundary of the moving image according to the motion speed of the moving image, it is possible to display a high-definition moving image without motion blurring.

If the input data is a moving image of one frame, since the boundary of the moving image in the first and second double frame data is Gaussian- or Sharpness-filtered according to the motion speed of the moving image and only the data of the boundary of the moving image is modulated such that a discontinuous artifact is prevented from being generated in the boundary of the moving image according to the motion speed of the moving image, it is possible to display a high-definition stereoscopic moving image without motion blurring.

Therefore, according to the present invention, it is possible to minimize a motion blurring phenomenon of a display image and to improve the display quality of the display image.

It will be apparent to those skilled in the art that various modifications can be made in the present invention without departing from the spirit or scope of the invention. Thus, it is intended that the present invention covers the modifications and variations of this invention provided they come within the scope of the appended claims and their equivalents.

What is claimed is:

1. An apparatus for driving a liquid crystal display device, the device comprising:

a liquid crystal panel having liquid crystal cells formed in regions defined by a plurality of gate lines and a plurality of data lines;

a timing controller which analyzes a motion speed of an image in input data and converts the input data of one frame into different first and second double frame data or identical first and second double frame data according to the motion speed;

a gate driver which sequentially supplies gate on voltages to the gate lines for each of first and second double frames under the control of the timing controller; and a data driver which converts the double frame data supplied from the timing controller into an analog video signal and supplies the analog video signal to the data lines under the control of the timing controller, wherein the timing controller comprises a data converter which converts the input data of one frame into the first and second double frame data using the modulated vertical synchronization signal and the motion speed, wherein the data converter comprises a double frame generator which generates the first and second double frame data using the input data of one frame, a moving image analyzer which analyzes the input data and generates a motion signal corresponding to the moving speed of the image; and an image modulator which differently sets gamma curves on a frame-by-frame basis according to the motion signal, and modulates the double frame data supplied from the double frame generator to supply the modulated double frame data to the data driver or bypasses the double frame data supplied from the double frame generator to the data driver, wherein the image modulator comprises a gamma curve setting unit which generates a bypass selection signal according to the motion signal corresponding to a still image or a gamma curve selection signal for differently setting the gamma curves on the frame-by-frame basis according to the motion signal corresponding to a moving image, a look-up table which registers a plurality of gamma curves for setting the gamma curve according to the motion speed, a gray scale generator which bypasses the double frame data to the data driver according to the bypass selection signal or modulates the double frame data by referring to the gamma curves registered in the look-up table corresponding to the gamma curve selection signal and supplies the modulated double frame data to the data driver.

2. The apparatus according to claim 1, wherein the drive frequencies of the first and second double frames are the double of the drive frequency of the input data.

3. The apparatus according to claim 1, wherein the timing controller further comprises:

a control signal generator which modulates a synchronization signal including externally input vertical and horizontal synchronization signals and generates data and gate control signals for displaying the double frame data on the liquid crystal panel.

4. The apparatus according to claim 3, wherein the moving image analyzer comprises:

a luminance separator which separates a luminance component from the input data;

a frame memory which stores the luminance component in a frame unit; and a motion detector which compares a luminance component of a previous frame supplied from the frame memory with a luminance component of a current frame supplied from the luminance separator and generates the motion signal.

5. The apparatus according to claim 3, wherein the look-up table comprises:

a first memory which registers a plurality of different gamma curves for an $N^{th}$ frame for modulating the first double frame data to a low gray scale so as to become close to a gray scale of '0' as the motion speed increases; and a second memory which registers a plurality of different gamma curves for an $N+1^{th}$ frame for modulating the second double frame data to a high gray scale so as to become close to a gray scale of '$2^i$-1' (i is the number of bits of the input data) as the motion speed increases.

6. The apparatus according to claim 5, wherein each of the plurality of different gamma curves for the $N^{th}$ frame includes a reference value for the $N^{th}$ frame corresponding to the motion speed so as to modulate a predetermined gray scale or less of the first double frame data to the gray scale of '0', and a curved line in which a ratio of an output gray scale to an input gray scale increases as the input gray scale increases between the reference value for the $N^{th}$ frame and the gray scale of '$2^i$-1'.

7. The apparatus according to claim 5, wherein each of the plurality of different gamma curves for the $N+1^{th}$ frame includes a reference value for the $N+1^{th}$ frame corresponding to the motion speed so as to modulate a predetermined gray scale or more of the second double frame data to the gray scale of '$2^i$-1', and a curved line in which a ratio of an output gray scale to an input gray scale decreases as the input gray scale increases between the reference value for the $N+1^{th}$ frame and the gray scale of '0'.

8. The apparatus according to claim 3, wherein the image modulator comprises:

a gamma curve setting unit which generates a bypass selection signal according to the motion signal corresponding to a still image or generates a gamma curve selection signal for differently setting the gamma curves on the frame-by-frame basis according to the motion signal corresponding to a moving image;

an image filter which filters the double frame data such that only an undershoot is generated in the boundary of the moving image of the double frame data supplied from the double frame generator according to the motion signal;

a look-up table which registers a plurality of gamma curves for setting the gamma curve according to the moving speed; and a gray scale generator which bypasses the filtered double frame data to the data driver according to the bypass selection signal or modulates the filtered double frame data by referring to the gamma curves registered in the look-up table corresponding to the gamma curve selection signal and supplies the modulated double frame data to the data driver.

9. The apparatus according to claim 8, wherein the image filter comprises:

a luminance/chrominance separator which separates luminance component and chrominance components from the double frame data supplied from the double frame generator;

a motion filter which filters the luminance component according to the motion signal;

a delay unit which delays the chrominance components while the motion filter filters the luminance component;

a mixer which mixes the delayed chrominance components with the filtered luminance component, generates the filtered double frame data, and supplies the generated double frame data to the gray scale generator.

10. The apparatus according to claim 9, wherein the motion filter comprises:

a line memory which stores the luminance component in the unit of at least three horizontal lines;

a low-pass filter which receives the luminance component based on j×j block unit (j is an integer of 3 or more) from the line memory and low-pass filters the luminance component based on j×j block unit;

a gray scale filter which minimizes an overshoot generated in the low-pass filtered luminance component based on j×j block unit and generates an undershoot according to the motion signal; and a multiplier which multiplies the luminance component, in which the undershoot is generated by the gray scale filter, by a gain value and supplies the filtered luminance component to the mixer.

11. The apparatus according to claim 10, wherein the gray scale filter comprises:

an adder which adds the luminance component of a peripheral portion except for a central portion in the low-pass filtered luminance component based on j×j block unit;

a comparator which compares the luminance component of the central portion with the luminance component added by the adder and generates a comparison signal;

a selector which selects and outputs the low-pass filtered luminance component based on j×j block unit according to the comparison signal;

a first filter which filters the luminance component based on j×j block unit supplied from the selector such that summation of the luminance component becomes '1' to minimize the overshoot and supplies the filtered luminance component to the multiplier; and a second filter which filters the luminance component based on j×j block unit supplied from the selector such that summation of the luminance component becomes '0' to generate the undershoot and supplies the filtered luminance component to the multiplier.

12. The apparatus according to claim 3, wherein the data converter comprises:

a double frame generator which generates the first and second double frame data using the input data of one frame;

a moving image analyzer which analyzes the input data, generates a motion signal corresponding to the motion speed of the image, and generates motion position information of the boundary of the moving image; and an image modulator which differently sets gamma curves on a frame-by-frame according to the motion signal, and modulates only data of the boundary of the moving image corresponding to the motion position information in the double frame data supplied from the double frame generator to supply the modulated data to the data driver or bypasses the double frame data supplied from the double frame generator to the data driver.

13. The apparatus according to claim 12, wherein the moving image analyzer comprises:

a luminance separator which separates a luminance component from the input data;

a frame memory which stores the luminance component in a frame unit; and a motion detector which compares a luminance component of a previous frame supplied from the frame memory with a luminance component of a current frame supplied from the luminance separator and generates the motion position information corresponding to the motion signal.

14. The apparatus according to claim 12, wherein the image modulator comprises:

a gamma curve setting unit which generates a bypass selection signal according to the motion signal corresponding to a still image or a gamma curve selection signal for differently setting the gamma curves on the frame-by-frame basis according to the motion signal corresponding to a moving image;

a look-up table which registers a plurality of gamma curves for setting the gamma curve according to the motion speed;

a gray scale generator which bypasses the double frame data to the data driver according to the bypass selection signal or modulates only the data of the boundary of the moving image corresponding to the motion position information in the double frame data by referring to the gamma curves registered in the look-up table corresponding to the gamma curve selection signal and supplies the modulated data to the data driver.

15. The apparatus according to claim 12, wherein the image modulator comprises:

a gamma curve setting unit which generates a bypass selection signal according to the motion signal corresponding to a still image or generates a gamma curve selection signal for differently setting the gamma curves on the frame-by-frame basis according to the motion signal corresponding to a moving image;

an image filter which filters the double frame data such that only an undershoot is generated in the boundary of the moving image of the double frame data supplied from the double frame generator according to the motion signal;

a look-up table which registers a plurality of gamma curves for setting the gamma curve according to the moving speed; and a gray scale generator which bypasses the filtered double frame data to the data driver according to the bypass selection signal or modulates only the data of the boundary of the moving image corresponding to the motion position information in the filtered double frame data by referring to the gamma curves registered in the look-up table corresponding to the gamma curve selection signal and supplies the modulated data to the data driver.

16. The apparatus according to claim 15, wherein the image filter comprises:

a luminance/chrominance separator which separates luminance component and chrominance components from the double frame data supplied from the double frame generator;

a motion filter which filters the luminance component according to the motion signal;

a delay unit which delays the chrominance components while the motion filter filters the luminance component;

a mixer which mixes the delayed chrominance components with the filtered luminance component, generates the filtered double frame data, and supplies the generated double frame data to the gray scale generator.

17. The apparatus according to claim 16, wherein the motion filter comprises:

a line memory which stores the luminance component in the unit of at least three horizontal lines;

a low-pass filter which receives the luminance component based on j×j block unit (j is an integer of 3 or more) from the line memory and low-pass filters the luminance component based on j×j block unit;

a gray scale filter which minimizes an overshoot generated in the low-pass filtered luminance component based on j×j block unit and generates an undershoot according to the motion signal; and a multiplier which multiplies the luminance component, in which the undershoot is generated by the gray scale filter, by a gain value and supplies the filtered luminance component to the mixer.

18. The apparatus according to claim 17, wherein the gray scale filter comprises:

an adder which adds the luminance component of a peripheral portion except for a central portion in the low-pass filtered luminance component based on j×j block unit;

a comparator which compares the luminance component of the central portion with the luminance component added by the adder and generates a comparison signal;

a selector which selects and outputs the low-pass filtered luminance component based on j×j block unit according to the comparison signal;

a first filter which filters the luminance component based on j×j block unit supplied from the selector such that summation of the luminance component becomes '1' to minimize the overshoot and supplies the filtered luminance component to the multiplier; and a second filter which filters the luminance component based on j×j block unit supplied from the selector such that summation of the luminance component becomes '0' to generate the undershoot and supplies the filtered luminance component to the multiplier.

* * * * *